US009161138B2

(12) United States Patent
Pedersen et al.

(10) Patent No.: US 9,161,138 B2
(45) Date of Patent: Oct. 13, 2015

(54) HEAD-WORN DEVICE WITH FLIGHT MODE

(71) Applicant: GN ReSound A/S, Ballerup (DK)

(72) Inventors: Brian Dam Pedersen, Ringsted (DK); Jesper Lund Nielsen, Ringsted (DK)

(73) Assignee: GN RESOUND A/S, Ballerup (DK)

( * ) Notice: Subject to any disclaimer, the term of this patent is extended or adjusted under 35 U.S.C. 154(b) by 71 days.

(21) Appl. No.: 13/633,851

(22) Filed: Oct. 2, 2012

(65) Prior Publication Data

US 2014/0087675 A1 Mar. 27, 2014

(30) Foreign Application Priority Data

Sep. 25, 2012 (EP) ..... 12185947

(51) Int. Cl.
*H04R 25/00* (2006.01)

(52) U.S. Cl.
CPC ..... *H04R 25/554* (2013.01); *H04R 25/552* (2013.01); *H04R 25/602* (2013.01); *H04R 2225/55* (2013.01); *H04R 2225/61* (2013.01); *H04R 2460/03* (2013.01)

(58) Field of Classification Search
CPC .. H04R 25/552; H04R 25/554; H04R 25/602; H04R 2225/55; H04R 2225/61; H04R 2460/03; H04W 88/02
See application file for complete search history.

(56) References Cited

U.S. PATENT DOCUMENTS

| | | | | |
|---|---|---|---|---|
| 5,721,783 | A | 2/1998 | Anderson | |
| 2003/0078076 | A1 | 4/2003 | Kuwajima et al. | |
| 2008/0267435 | A1 * | 10/2008 | Schumaier | 381/314 |
| 2011/0249836 | A1 * | 10/2011 | Solum et al. | 381/314 |

FOREIGN PATENT DOCUMENTS

| | | | |
|---|---|---|---|
| EP | 2 378 794 | A1 | 10/2011 |
| JP | 2002-141841 | A | 5/2002 |
| JP | 2003-069669 | A | 3/2003 |
| JP | 2003-125075 | A | 4/2003 |
| WO | WO 2007/147415 | A1 | 12/2007 |
| WO | WO 2007/147416 | A1 | 12/2007 |
| WO | 2008/134345 | A1 | 11/2008 |

OTHER PUBLICATIONS

Extended European Search Report dated Feb. 14, 2013 for EP Patent Application No. 12185947.4.
First Office Action and Notice of Rejection for corresponding Japanese Patent Application No. 2013-197322, dated Oct. 21, 2014 (2 pages).

* cited by examiner

*Primary Examiner* — Lewis West
*Assistant Examiner* — Dong-Chang Shiue
(74) *Attorney, Agent, or Firm* — Vista IP Law Group, LLP

(57) ABSTRACT

A head-worn device includes: a transceiver for wireless interconnection of the head-worn device with another device; and a housing for accommodation of parts of the head-worn device, the housing having a battery compartment for accommodation of a battery for power supply of the head-worn device, and a battery cover for closing the battery compartment; and a controller that is configured to disable the transceiver in response to repeated opening and closing operations of the battery cover, while the parts of the head-worn device are operational.

20 Claims, 3 Drawing Sheets

HEAD-WORN DEVICE WITH FLIGHT MODE

RELATED APPLICATION DATA

This application claims priority to, and the benefit of, European Patent Application No. 12185947.4, filed on Sep. 25, 2012, pending, the entire disclosure of which is expressly incorporated by reference herein.

FIELD OF TECHNOLOGY

A head-worn device, such as a hearing aid, with a flight mode is disclosed. A user command for entry into flight mode is provided without requiring additional user interface hardware.

BACKGROUND

Operation of devices that send or receive signals is generally prohibited on board commercial aircrafts while in flight, due to the potential impact on aircraft avionics and the potential for interference with ground cell networks.

Flight mode is a setting available on many electronic devices that, when engaged, suspends many of the device's signal transmitting functions, thereby disabling, e.g. a mobile phone's capacity to place or receive calls or text messages while still permitting use of other functions that do not require signal transmission; e.g., games, built-in camera, MP3 player.

Flight mode permits the user to operate the device while on board a commercial aircraft while in flight.

Other names include airplane mode, aeroplane mode, offline mode, and standalone mode.

Head-worn devices with transceivers for wireless communication with other devices and with other functions that do not require wireless communication are well-known, e.g. hearing aids.

SUMMARY

Applicant of the subject application has determined that it would be desirable to have a head-worn device with a flight mode in which the device's signal transmission and reception functions are disabled permitting operation of other functions of the device in a commercial aircraft while in flight.

Thus, a head-worn device is provided with

- a transceiver for wireless interconnection of the head-worn device with another device, and
- a housing for accommodation of at least some of the parts of the head-worn device and having
- a battery compartment for accommodation of a battery for power supply of the head-worn device,
- a battery cover for closing the battery compartment, and wherein the head-worn device further has
- a controller that is configured to disable the transceiver while other parts of the head-worn device are operational in response to repeated opening and closing operations of the battery cover.

It is an advantage of the new head-worn device that the user can operate the device to enter into flight mode in which the transceiver of the device is disabled, e.g. by turn off of the transceiver, so that usage of other functions of the device is permitted in a commercial aircraft while in flight.

Head-worn devices, such as hearing aids, are getting smaller and smaller, largely for cosmetic reasons. Thus, the available area for user interface controls is getting smaller and smaller, and in particular for in-the-ear hearing aids, the battery cover occupies a significant part of the area exposed to the user when the hearing aid is inserted in the ear of the user and typically, there is not sufficient space for further user controls.

It is another advantage of the new head-worn device that the user interface requires no additional hardware in order to provide a user command for entry into flight mode.

Preferably, a timer is provided for monitoring elapsed time from closure of the battery cover.

Preferably, a short boot counter is provided for counting events of opening the battery cover before a boot time threshold has elapsed.

In the following, the term "short boot" denotes a closure of the battery cover with a duration shorter than the boot time threshold, and the term "long boot" denotes a closure of the battery cover with a duration longer than the boot time threshold.

In some cases, a battery may be accommodated in a compartment formed by a support structure in the housing that allows access to the battery poles for power supply of the circuitry of the head-worn device by the battery. The support structure includes a battery cover, such as a battery lid or battery door, that can be opened by the user allowing the user to access and exchange batteries. The support structure may be arranged so that the battery is drawn out of the housing together with a battery lid like a drawer, or a battery door may be hinged to the housing so that it swings open thereby withdrawing the battery from the device housing in a rotational movement. The device is turned off when the battery cover is opened, and the device is turned on when the battery cover is fully closed. Electrical terminals are provided in the battery compartment for connection of the battery poles with the circuitry of the head-worn device for power supply of the device.

Opening of the battery cover may be detected as the battery moves together with the battery cover out of contact with the electrical terminals and power supply of the head-worn device is lost. In this event, updated values of flags and counters relating to whether the head-worn device was in flight mode during the previous powered period of the head-worn device and to the duration of the previous powered period are continuously stored in non-volatile memory to be available at the next power-up event of the head-worn device.

Alternatively, opening of the battery cover may be detected with a switch associated with the battery cover as is well-known in the art. The switch opens and closes together with the door, and the output of the switch is input to the controller of the head-worn device that performs the detection of opening and closing of the battery cover in response to the state of the switch. This arrangement allows detection of opening of the battery cover before power is lost so that values of flags and counters relating to whether the head-worn device was in flight mode during the previous powered period of the head-worn device and to the duration of the previous powered period can be stored in non-volatile memory before power is lost.

In one embodiment, when the battery door is closed, and the head-worn device was not in flight mode during the previous powered period, and the head-worn device was powered for a period longer than the boot time threshold, e.g. 10 seconds, the head-worn device including the transceiver is turned on, and enabled if required, and the head-worn device, including the transceiver, remains turned on and enabled as long as the battery door is closed.

In the event that the previous boot is a long boot, and the battery cover is opened before the boot time threshold has elapsed since the battery cover was closed, i.e., a short boot for the first time, a short boot counter value is incremented from zero to one and stored in non-volatile memory, and the head-worn device including the transceiver is turned off.

When the battery cover is subsequently closed, the head-worn device including the transceiver is again turned on, and enabled if required and the head-worn device, including the transceiver, remains turned on and enabled as long as the battery cover is closed.

If the battery cover is opened before the boot time threshold has elapsed since the battery cover was closed, the short boot counter values is incremented from one to two and stored in non-volatile memory, and the head-worn device including the transceiver is turned off.

When the battery cover is subsequently closed, the head-worn device is turned on, however the transceiver is not enabled, e.g. not turned on, since the short boot counter value is larger than or equal to two, and a flight mode flag is set indicating that the head-worn device is now in flight mode, i.e. the transceiver is disabled, e.g. not turned on. Further, the short boot counter value is reset to zero.

If the battery cover is opened before the boot time threshold has elapsed since the battery cover was closed, the short boot counter values is incremented to a value larger than two and stored in non-volatile memory, and the head-worn device is turned off.

The controller may be configured so that when the head-worn device is in flight mode and the user needs to change the battery, the user has to perform repeated opening and closing operations of the battery cover to re-enter flight mode.

The controller may further be configured so that when the battery cover is opened in flight mode and then closed, the head-worn device exclusive the transceiver is turned on, or the transceiver is otherwise disabled, and in the event that the battery cover stays closed for longer than the boot time threshold, the transceiver is also turned on, or otherwise enabled, and the flight mode flag is reset.

The above-described functionality can also be implemented with various counter values and flags. For example, in other embodiments, entry into flight mode may require 3 or more consecutive opening and closing operations of the battery cover, with durations of the respective closing operations less than the boot time threshold. In another example, different boot time threshold values may be applied to different closing operations in the sequence of consecutive opening and closing operations. Also, in flight mode, closing of the battery cover for longer than the boot time threshold may lead to maintenance of the flight mode, while normal mode or non-flight mode, i.e. the transceiver is enabled, may be entered by consecutive opening and closing operations of the battery cover.

The controller of the new head-worn device may be implemented in connection with hardware or software or, where appropriate, with a combination of both.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable files, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

The transceiver may be configured for interconnection of the head-worn device with a wireless network. The wireless network may facilitate interconnection with a plurality of other devices in the network, such as remote controllers, fitting instruments, mobile phones, headsets, door bells, alarm systems, broadcast systems, etc.

The head-worn device may be a hearing aid comprising an input transducer for conversion of acoustic sound into an electronic sound signal, a signal processor for processing the electronic sound signal into a hearing loss compensated signal, and an output transducer for conversion of the hearing loss compensated signal into an acoustic output signal for transmission towards the eardrum of a user of the hearing aid.

The hearing aid may form part of a binaural hearing aid system.

Advantageously, the flight mode leads to power saving. Since the device has no connectivity to network, it is not required to search continuously for reception and so a large amount of power is saved.

In some embodiments, a head-worn device includes: a transceiver for wireless interconnection of the head-worn device with another device; and a housing for accommodation of parts of the head-worn device, the housing having a battery compartment for accommodation of a battery for power supply of the head-worn device, and a battery cover for closing the battery compartment; and a controller that is configured to disable the transceiver in response to repeated opening and closing operations of the battery cover, while the parts of the head-worn device are operational.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

In the following, the new head-worn device will be further explained with reference to the drawing wherein.

DETAILED DESCRIPTION OF THE EMBODIMENTS

Various embodiments are described hereinafter with reference to the figures. It should be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

The new head-worn device will now be described more fully hereinafter with reference to the accompanying drawings, in which various embodiments are shown. The new head-worn device may be embodied in different forms not shown in the accompanying drawings and should not be construed as limited to the embodiments and examples set forth herein.

Figure 1:
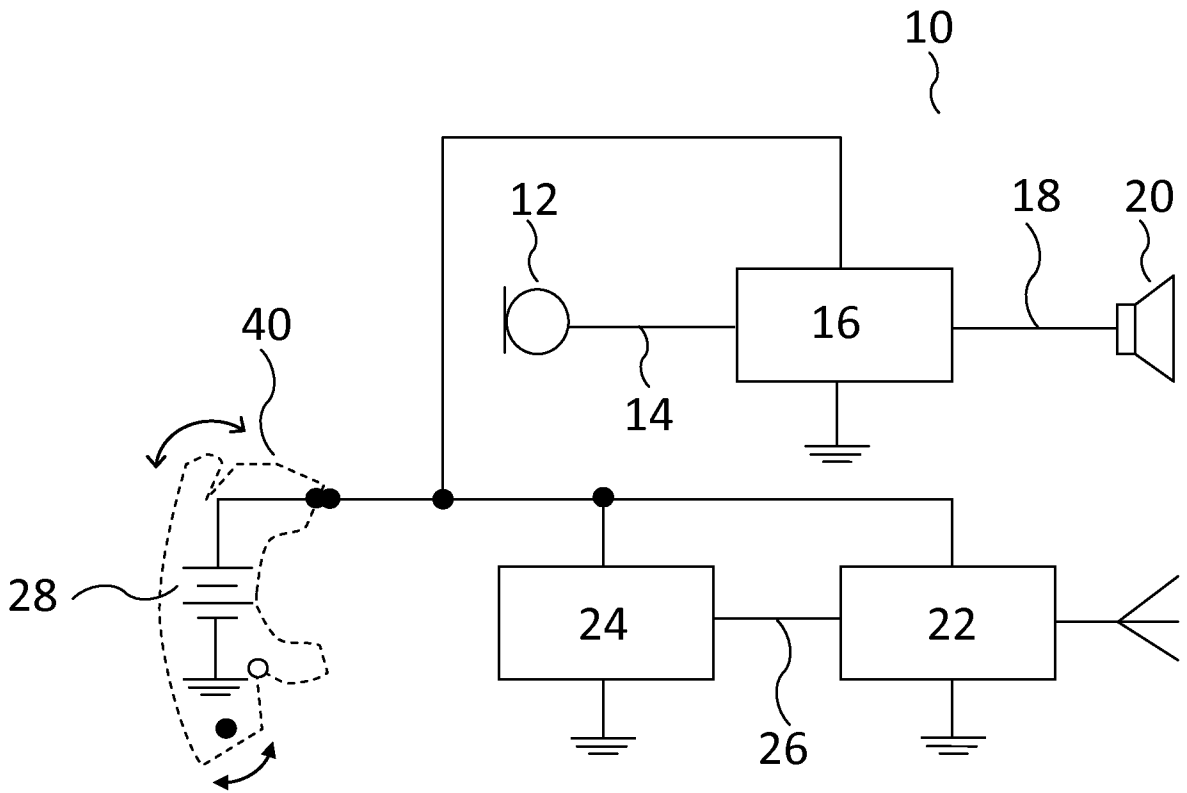
FIG. 1 schematically illustrates an embodiment of the new head-worn device.

FIG. 1 schematically illustrates a head-worn device in the form of a hearing aid 10 with an input transducer 12, typically a microphone, for conversion of acoustic sound into an electronic sound signal 14, a signal processor 16 for processing the electronic sound signal 14 into a hearing loss compensated signal 18, and an output transducer 20 for conversion of the hearing loss compensated signal 18 into an acoustic output signal for transmission towards the eardrum of a user of the hearing aid 10.

The hearing aid 10 also has a transceiver 22 for wireless interconnection of the hearing aid 10 with another device, and a housing (not shown) for accommodation of at least some of the parts of the hearing aid 10 and having a battery compartment (not shown) for accommodation of a battery 28 for power supply of the hearing aid 10, a battery door 40 indicated by dashed line for closing the battery compartment.

The hearing aid 10 further has a controller 24 that is configured to enable or disable the transceiver 22, either by controlling a logic input 26 that controls the transceiver to be enabled or disabled as is well-known in the art, or (not shown) simply by connecting or disconnecting the power supply 28 to the transceiver 22.

The controller 24 enables or disables the transceiver 22 in response to repeated opening and closing operations of the battery door as further explained below.

It is an important advantage of the new hearing aid 10 that the user can operate the device to enter into flight mode in which the transceiver 22 of the device 10 is disabled, e.g. by turn off of the transceiver, so that usage of other functions of the device 22 is permitted in a commercial aircraft while in flight.

Hearing aids are getting smaller and smaller, largely for cosmetic reasons. Thus, the available area for user interface controls is getting smaller and smaller, and in particular for in-the-ear hearing aids, the battery door occupies a significant part of the area exposed to the user when the hearing aid is inserted in the ear of the user and typically, there is not sufficient space for further user controls.

It is an important advantage of the new hearing aid 10 that the user interface requires no additional hardware in order to provide a user command for entry into flight mode.

A timer (not shown) is provided for monitoring elapsed time from closure of the battery door.

A short boot counter (not shown) is provided for counting events of opening the battery door before a boot time threshold has elapsed.

Figure 2:
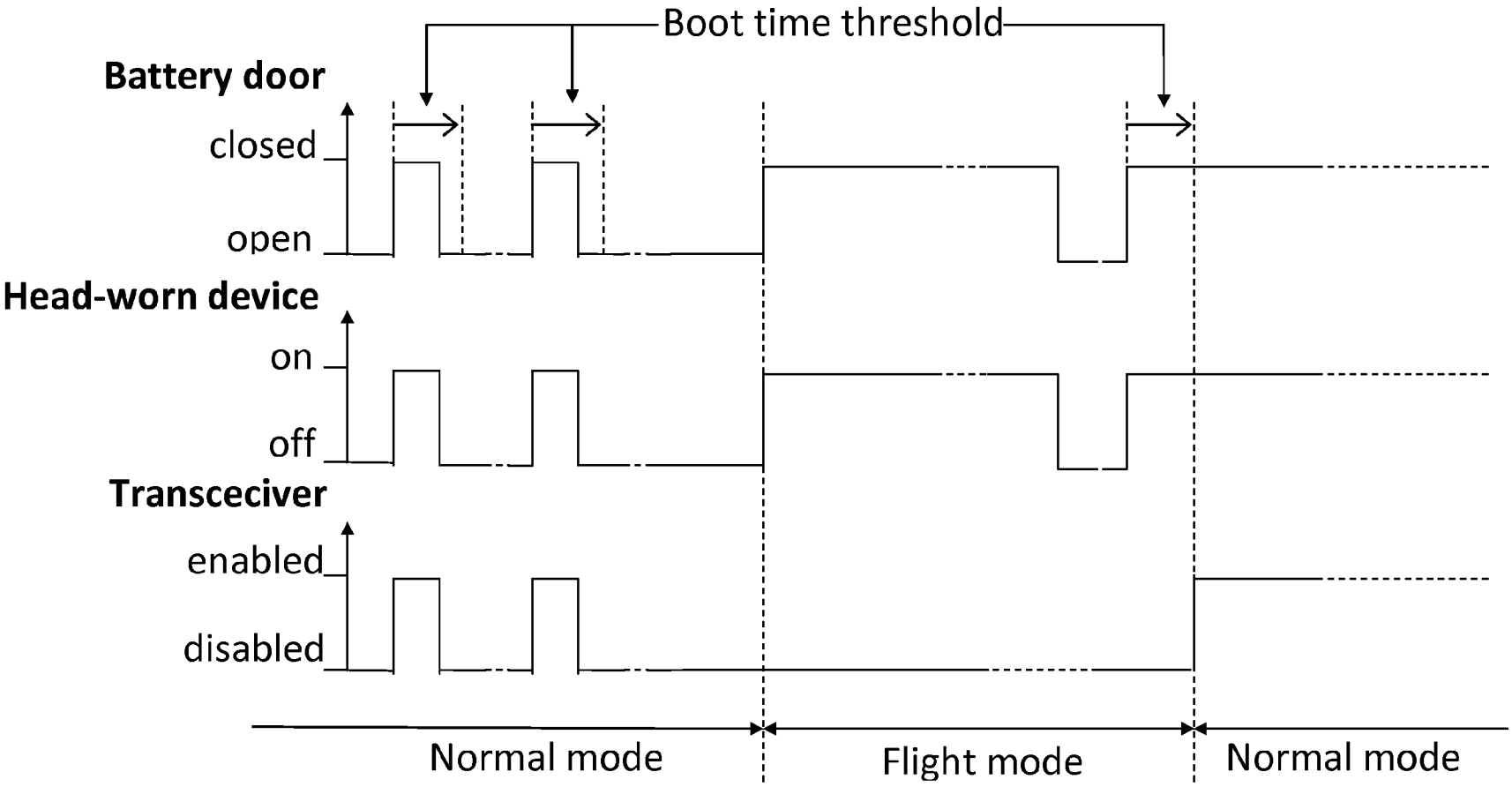
FIG. 2 is a plot illustrating user operation of the battery cover.
Figure 3:
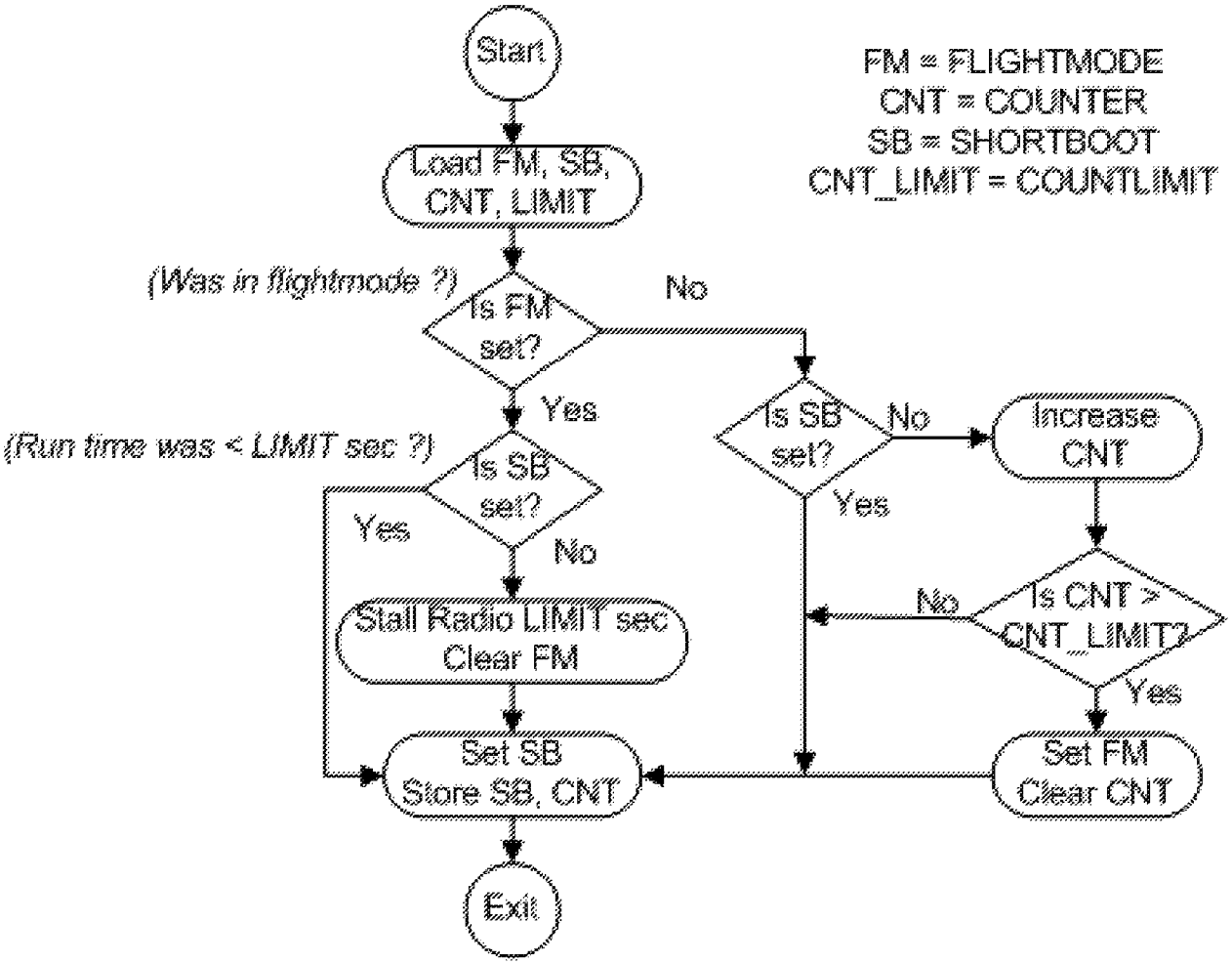
FIG. 3 is a flowchart of the user interface.

The operation of the illustrated hearing aid 10 is now explained with reference to FIGS. 2 and 3:

In the illustrated hearing aid 10, opening of the battery cover 40 disconnects the battery 28 from the electrical terminals of the battery compartment as the battery moves together with the battery cover 40 out of contact with the electrical terminals and power supply of the head-worn device is lost.

While powered, updated values of a flight mode flag indicating whether the head-worn device was in flight mode (value=1) during the previous powered period of the head-worn device, or not (flag=0), a short boot flag indicating whether the previous powered period of the head-worn device was a short boot (flag=1), or not (flag=0), in response to the current value of the timer counting the elapsed time from closure of the battery cover as compared to the boot time threshold, and the short boot counter for counting the number of short boots are continuously stored in non-volatile memory to be available at the next power-up event of the head-worn device.

When the battery cover 40 is closed, the controller 24 checks the value of the flight mode flag, i.e. the controller 24 tests whether the head-worn device 10 was in flight mode during the previous powered period of the head-worn device 10.

If not in flight mode previously, the controller 24 enables the transceiver 22, and the transceiver 22 remains enabled as long as the battery cover 40 is closed.

The short boot counter value is incremented and the updated value is stored in non-volatile memory so that the present powered period is stored in non-volatile memory as a short boot period although it is not yet known whether the current period will be a short boot or a long boot. If the short boot counter value exceeds a threshold value, e.g. two, the controller controls the head-worn device to enter flight mode provided that the current power period elapses into a long boot.

If the battery cover 40 is opened before elapse of the boot time threshold, the correct recorded (short boot) values are already stored in non-volatile memory; however, if the head-worn device remains powered for a longer period than the boot time threshold, the short boot flag and the short boot counter are cleared and stored in the non-volatile memory, so that the power period is stored as a long boot period during which the head-worn device was not in flight mode.

When the hearing aid 10 is in flight mode and the user needs to change the battery, the user has to perform repeated opening and closing operations of the battery door to re-enter flight mode as explained above.

In the event the user desires to leave flight mode and go into normal mode, the user merely has to open the battery door in flight mode and then perform a long boot. The transceiver is the turned on when the boot time threshold has elapsed, and not before in order to take into account that the battery door may be closed earlier, i.e. short boot that may lead to a user command to remain in flight mode.

Obviously, the above-described functionality can also be implemented with other counter values and flags. For example, in other embodiments, entry into flight mode may require 3 or more consecutive opening and closing operations of the battery door, with durations of the respective closing operations less than the boot time threshold. In another example, different boot time threshold values may be applied to different closing operations in the sequence of consecutive opening and closing operations. Also, in flight mode, closing of the battery door for longer than the boot time threshold may lead to maintenance of the flight mode, while normal mode or non-flight mode, i.e. the transceiver is enabled, may be entered by consecutive opening and closing operations of the battery door.

The transceiver 22 may be configured for interconnection of the hearing aid 10 with a wireless network. The wireless network may facilitate interconnection with a plurality of other devices in the network, such as remote controllers, fitting instruments, mobile phones, headsets, door bells, alarm systems, broadcast systems, etc.

The hearing aid 10 may form part of a binaural hearing aid system.

Advantageously, the flight mode leads to power saving. Since the device has no connectivity to network, it is not required to search continuously for reception and so a large amount of power is saved.

In another head-worn device (not shown), the battery cover co-operates with a switch 30 that indicates opening of the battery cover without disconnecting the battery from the circuitry. The state of the switch is input to the controller that controls the flight mode and normal mode in response to the switch states in a way similar to the one disclosed above.

Although particular embodiments have been shown and described, it will be understood that they are not intended to limit the claimed inventions, and it will be obvious to those skilled in the art that various changes and modifications may be made without departing from the scope of the claimed inventions. The specification and drawings are, accordingly, to be regarded in an illustrative rather than restrictive sense. The claimed inventions are intended to cover alternatives, modifications, and equivalents.

The invention claimed is:

1. A head-worn device, comprising:

a transceiver for wireless interconnection of the head-worn device with another device;

a housing for accommodation of parts of the head-worn device, the housing having a battery compartment for accommodation of a battery for power supply of the head-worn device, and a battery cover for closing the battery compartment; and a controller that is configured to disable the transceiver in response to repeated opening and closing operations of the battery cover, while the parts of the head-worn device are operational.

2. The head-worn device according to claim 1, wherein the controller is configured to enable the transceiver after the transceiver has been disabled while the parts of the head-worn device are operational.

3. The head-worn device according to claim 1, further comprising a timer for monitoring elapsed time from a closure of the battery cover.

4. The head-worn device according to claim 1, further comprising a short boot counter for counting events of opening the battery cover before a boot time threshold has elapsed.

5. The head-worn device according to claim 4, wherein the controller is configured to disable the transceiver in response to at least two opening and closing operations of the battery cover during which the battery cover stays closed for less than the boot time threshold.

6. The head-worn device according to claim 4, wherein the controller is configured to enable the transceiver after the transceiver has been disabled in response to a closing operation of the battery cover during which the battery cover stays closed for longer than the boot time threshold.

7. The head-worn device according to claim 1, wherein the transceiver is configured for interconnection of the head-worn device with a wireless network.

8. The head-worn device according to claim 1, wherein the head-worn device comprises a hearing aid comprising:

an input transducer for conversion of acoustic sound into an electronic sound signal;

a signal processor for processing the electronic sound signal into a hearing loss compensated signal; and an output transducer for conversion of the hearing loss compensated signal into an acoustic output signal for transmission towards an eardrum of a user of the hearing aid.

9. The head-worn device according to claim 8, wherein the hearing aid is a part of a binaural hearing aid system.

10. A head-worn device, comprising:

a transceiver for wireless communication with another device;

a housing for accommodation of parts of the head-worn device, the housing having a battery compartment for accommodation of a battery for power supply of the head-worn device, and a battery cover for closing the battery compartment; and a controller that is configured to disable the transceiver based on two or more opening operations of the battery cover.

11. The head-worn device according to claim 10, wherein the controller is configured to enable the transceiver after the transceiver has been disabled while the parts of the head-worn device are operational.

12. The head-worn device according to claim 10, further comprising a timer for monitoring elapsed time from a closure of the battery cover.

13. The head-worn device according to claim 10, further comprising a short boot counter for counting events of opening the battery cover before a boot time threshold has elapsed.

14. The head-worn device according to claim 13, wherein the controller is configured to disable the transceiver in response to at least two opening and closing operations of the battery cover during which the battery cover stays closed for less than the boot time threshold.

15. The head-worn device according to claim 13, wherein the controller is configured to enable the transceiver after the transceiver has been disabled in response to a closing operation of the battery cover during which the battery cover stays closed for longer than the boot time threshold.

16. The head-worn device according to claim 10, wherein the transceiver is configured for interconnection of the head-worn device with a wireless network.

17. The head-worn device according to claim 10, wherein the head-worn device comprises a hearing aid comprising:

an input transducer for conversion of acoustic sound into an electronic sound signal;

a signal processor for processing the electronic sound signal into a hearing loss compensated signal; and an output transducer for conversion of the hearing loss compensated signal into an acoustic output signal for transmission towards an eardrum of a user of the hearing aid.

18. The head-worn device according to claim 17, wherein the hearing aid is a part of a binaural hearing aid system.

19. The head-worn device according to claim 10, wherein the controller is configured to disable the transceiver also based on a first closing operation of the battery cover, wherein the two or more opening operations of the battery cover comprises a first opening operation and a second opening operation, and wherein the first closing operation is temporally between the first opening operation and the second opening operation.

20. The head-worn device according to claim 19, wherein the controller is configured to disable the transceiver also based on a second closing operation of the battery cover, and wherein the second closing operation is temporally after the second opening operation.

* * * * *